US009220308B2

(12) United States Patent
Boyle

(10) Patent No.: US 9,220,308 B2
(45) Date of Patent: Dec. 29, 2015

(54) HEAD BAND

(71) Applicant: Alf Wear, Murray, UT (US)

(72) Inventor: Kevin Boyle, Park City, UT (US)

(73) Assignee: Alf Wear, Salt Lake City, UT (US)

( * ) Notice: Subject to any disclaimer, the term of this patent is extended or adjusted under 35 U.S.C. 154(b) by 30 days.

(21) Appl. No.: 13/832,934

(22) Filed: Mar. 15, 2013

(65) Prior Publication Data

US 2014/0259286 A1 Sep. 18, 2014

(51) Int. Cl.
*A41D 20/00* (2006.01)

(52) U.S. Cl.
CPC ..... *A41D 20/00* (2013.01)

(58) Field of Classification Search
CPC ..... A42C 5/02; A42C 5/00; A42C 5/04; A42B 1/22; A42B 1/069; A42B 3/0406; A42B 3/145; A41D 20/00
USPC ..... 2/181, 181.4, 181.6, 181.8, 2/181.1–181.3, 182.6–182.8, 183
See application file for complete search history.

(56) References Cited

U.S. PATENT DOCUMENTS

| | | | | |
|---|---|---|---|---|
| 4,118 | A | 7/1845 | Genin | |
| 1,209,093 | A | 12/1916 | Whitlow | |
| 1,502,856 | A | 7/1924 | Kaufman | |
| 1,503,287 | A | 7/1924 | Pizzutiello | |
| 1,647,030 | A | 10/1927 | Zimmerman | |
| 1,955,986 | A | 4/1934 | Tice | |
| 2,437,748 | A | 3/1948 | Malcom | |
| 2,818,574 | A | 1/1958 | Burnison | |
| 3,766,565 | A | 10/1973 | Cozzens | |
| 3,780,382 | A | 12/1973 | Boden | |
| 3,992,720 | A | 11/1976 | Nicolinas | |
| 4,101,981 | A | 7/1978 | Boden | |
| 4,292,689 | A | 10/1981 | Townsend, Jr. | |
| 4,390,998 | A | 7/1983 | Gallin | |
| 4,434,514 | A | 3/1984 | Sundahl et al. | |
| 5,101,516 | A | 4/1992 | Scarnato | |
| 5,331,687 | A | 7/1994 | Kronenberger | |
| 5,608,917 | A | 3/1997 | Landis et al. | |
| 5,875,493 | A * | 3/1999 | MacDonald et al. | 2/172 |
| 5,950,245 | A | 9/1999 | Binduga | |
| 5,956,759 | A | 9/1999 | Benedict | |
| 5,978,968 | A | 11/1999 | Lee | |
| 6,199,214 | B1 | 3/2001 | Campbell | |
| 6,314,587 | B1 | 11/2001 | Fang | |
| 6,314,588 | B1 | 11/2001 | Fang | |
| 6,341,382 | B1 | 1/2002 | Ryvin et al. | |
| 6,367,085 | B1 * | 4/2002 | Berg | 2/202 |
| 6,691,322 | B2 | 2/2004 | Held | |
| 7,000,262 | B2 | 2/2006 | Bielefeld | |
| 7,043,772 | B2 | 5/2006 | Bielefeld et al. | |
| 7,497,097 | B2 | 3/2009 | Herr | |
| 7,707,695 | B2 | 5/2010 | Dubois | |

(Continued)

*Primary Examiner* — Andrew W Collins
(74) *Attorney, Agent, or Firm* — Venable LLP; Steven J. Schwarz; Tamatane J. Aga

(57) ABSTRACT

A head band comprises a band portion and a tightening portion. The band portion has a first band and a second band, wherein an outer surface of the first band opposes an inner surface of the second band. The head band further comprises at least one spacer between the first and the second band forming a gap between the first band and the second band. The tightening portion has a strap and a tightener configured to tighten the strap, wherein the strap is hingedly connected at approximately each end of the band portion. Other embodiments of the head band, and visors, caps, and hats incorporating the head band, are described herein.

22 Claims, 9 Drawing Sheets

(56) References Cited

U.S. PATENT DOCUMENTS

| | | | | |
|---|---|---|---|---|
| 7,865,968 | B2 | 1/2011 | Lilenthal et al. | |
| 8,056,152 | B2 | 11/2011 | Brace | |
| 8,161,576 | B2 | 4/2012 | Lemke et al. | |
| 2006/0015986 | A1 | 1/2006 | Bielefeld | |
| 2006/0048285 | A1 | 3/2006 | Bielefeld et al. | |
| 2006/0080761 | A1 | 4/2006 | Huh | |
| 2009/0241240 | A1 | 10/2009 | Han | |
| 2010/0146679 | A1 | 6/2010 | Heil | |
| 2011/0283440 | A1 | 11/2011 | Higgins et al. | |
| 2012/0144565 | A1* | 6/2012 | Huh | 2/421 |
| 2012/0144567 | A1* | 6/2012 | Huh | 2/424 |
| 2013/0111653 | A1* | 5/2013 | Huh | 2/421 |
| 2013/0263358 | A1* | 10/2013 | Fleischmann | 2/182.8 |

* cited by examiner

HEAD BAND

BACKGROUND

Sweat bands have long been known in the art as a way to wick away sweat from a person's forehead in order to, for example, prevent sweat from interfering with a person's vision. However, sweat bands, especially in hot weather, often fail to direct heat away from a person's head. Rather, conventional sweat band construction typically trap hot air generated by the person's head within the area contained by the sweat band.

SUMMARY

According to an embodiment, a head band comprises a band portion and a tightening portion; the band portion having a first band and a second band, wherein an outer surface of the first band opposes an inner surface of the second band; at least one spacer between the first and the second band forming a gap between the first band and the second band; the tightening portion having a strap and a tightener configured to tighten the strap, wherein the strap is hingedly connected at approximately each end of the band portion.

According to an embodiment, an apparatus for wearing on a head comprises a band portion and a tightening portion; the band portion having a first band and a second band, wherein an outer surface of the first band opposes an inner surface of the second band; at least one spacer between the first and the second band forming a gap between the first band and the second band; a visor extending from a bottom edge of an outer surface of the second band; the tightening portion having a strap and a tightener configured to tighten the strap, wherein the strap is hingedly connected at approximately each end of the band portion According to another embodiment, an apparatus for wearing on a head comprises a band portion and a tightening portion; the band portion having a first band and a second band, wherein an outer surface of the first band opposes an inner surface of the second band; at least one spacer between the first and the second band forming a gap between the first band and the second band; a visor extending from a bottom edge of an outer surface of the second band; the tightening portion having a strap and a tightener configured to tighten the strap, wherein the strap is hingedly connected at approximately each end of the band portion; and a cap portion, wherein the cap portion is attached to the band portion; wherein the tightener protrudes from the opening According to an embodiment, an apparatus for wearing on a head comprises a band portion and a tightening portion; the band portion having a first band and a second band, wherein an outer surface of the first band opposes an inner surface of the second band; at least one spacer between the first and the second band forming a gap between the first band and the second band; the tightening portion having a strap and a tightener configured to tighten the strap, wherein the strap is hingedly connected at approximately each end of the band portion; and a hat portion, wherein the hat portion extends over an outer surface of the second band.

BRIEF DESCRIPTION OF THE DRAWINGS

The features and advantages of the invention will be apparent from the following drawings wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. For example, a head band is used for illustrative purposes in the title and description of the embodiments of the present invention. However, the invention is not intended to be limited to the specific terminology so selected and may be configured for other types of uses. A person skilled in the relevant art will recognize that other equivalent parts can be employed and other methods developed without departing from the spirit and scope of the invention.

Figure 1:
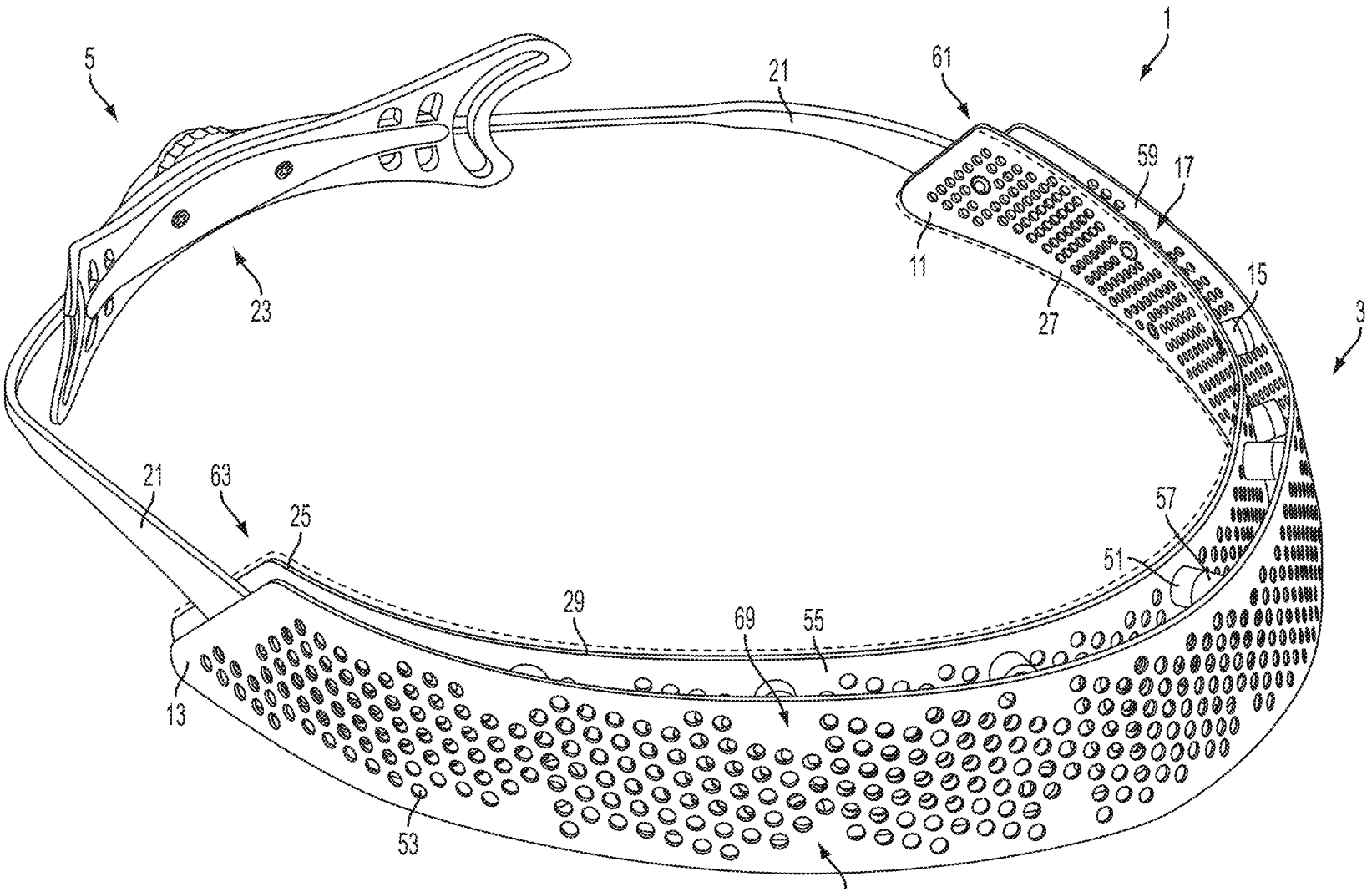
FIG. 1 is a perspective view of a first embodiment of a head band.

An embodiment of a head band 1 is shown on FIG. 1. The head band 1 generally comprises a band portion 3 and a tightening portion 5. The band portion 3 generally comprises two bands 11 and 13 opposing each other and having at least one or a plurality of spacers 15 therebetween. According to an embodiment, the spacers 15 form an air space or gap 17 between the two bands 11 and 13. The tightening portion 5 generally comprises two straps 21 and a tightening mechanism 23. However, it is foreseen in other embodiments that the tightening portion 5 may employ a single strap. As shown on FIG. 1, the head band 1 generally forms a circular band, for example, in the shape of a wearer's head. According to an embodiment, a fabric 25 may be attached to an inner surface 27 of the first or inner band 11 such as by, for example, stitching, bonding (e.g., glue), ultrasonic welding, or co-molding. The fabric 25 may be any type of fabric such as, for example, cotton, wool, a synthetic fabric, or a technical wicking fabric as known to one of ordinary skill in the art. Additionally or alternatively, the fabric 25 can comprise nylon knit or woven materials made from Polyester, polypropylene, wool, cotton, linen, hemp, coffee, and blends thereof. Additionally or alternatively, any of the foregoing materials can include polymer and/or chemical finishes to increase performance of wicking and/or or water transport.

According to an embodiment, in particular, the fabric 25 may cover the inner surface 27 of the inner band 11 and wrap or fold around all or some of the edges 29 of the inner band 11.

Figure 5:
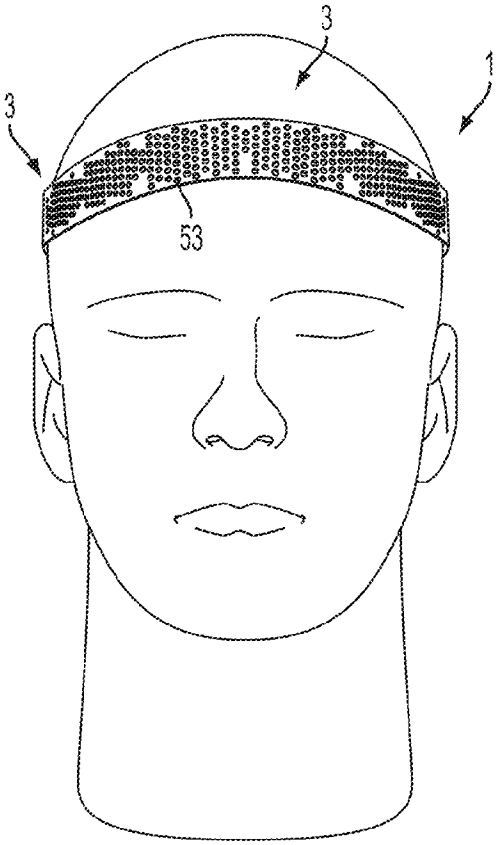
FIG. 5 is a front view of the head band of FIG. 1, shown for illustrative purposes on a head.
Figure 4:
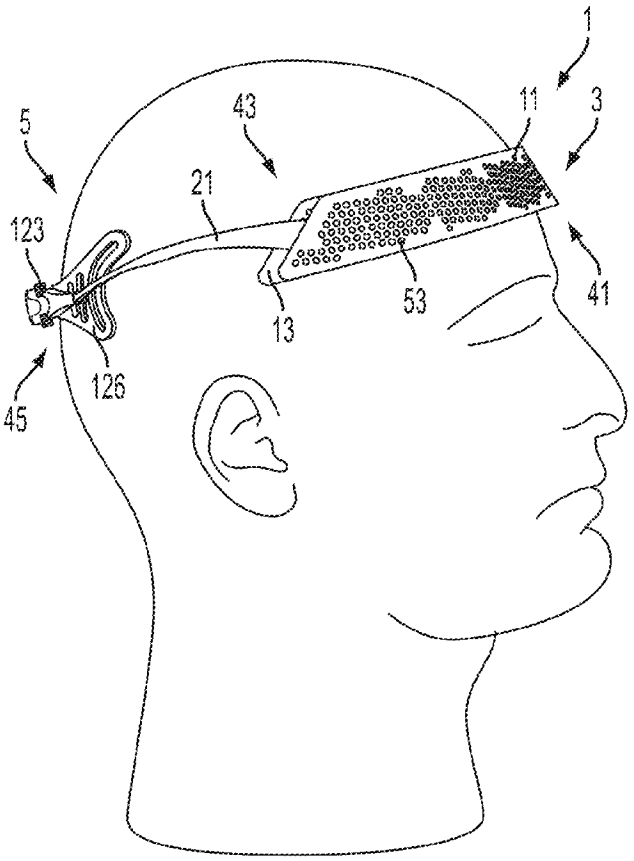
FIG. 4 is a side view of the head band of FIG. 1, shown for illustrative purposes on a head.

As shown at FIGS. 4 and 5, the fabric 25 may provide comfort to the user by engaging the soft surface of the fabric 25 with the forehead of the wearer and/or preventing edges 29 of the inner band 11 from causing discomfort or injury to a person.

Figure 2:
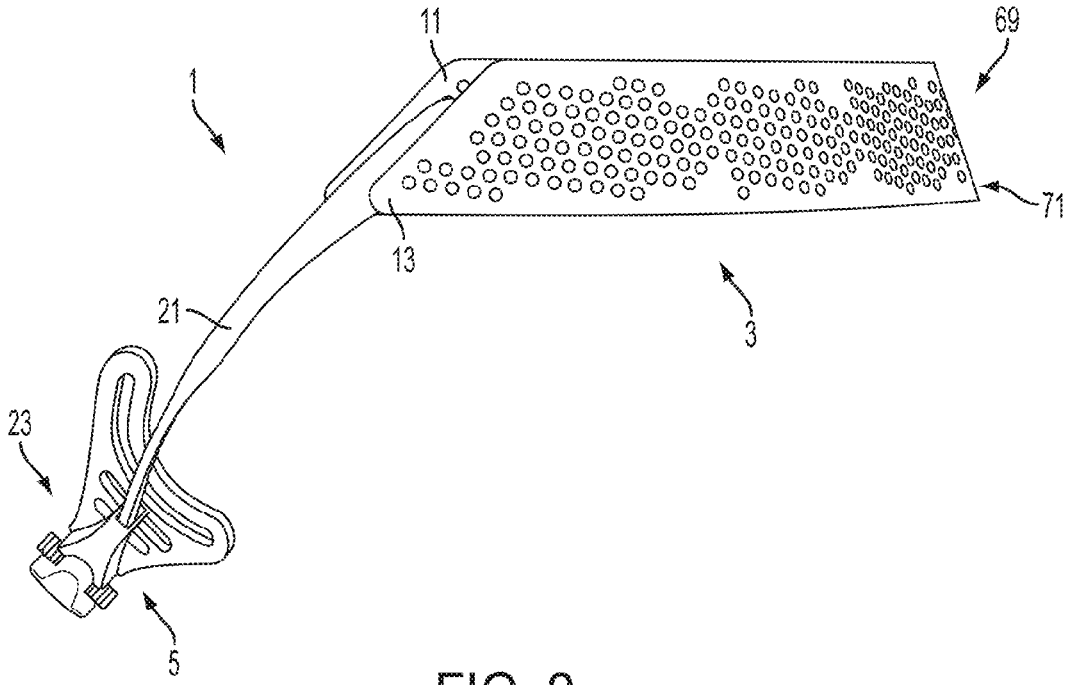
FIG. 2 is a side view of the head band of FIG. 1.
Figure 3:
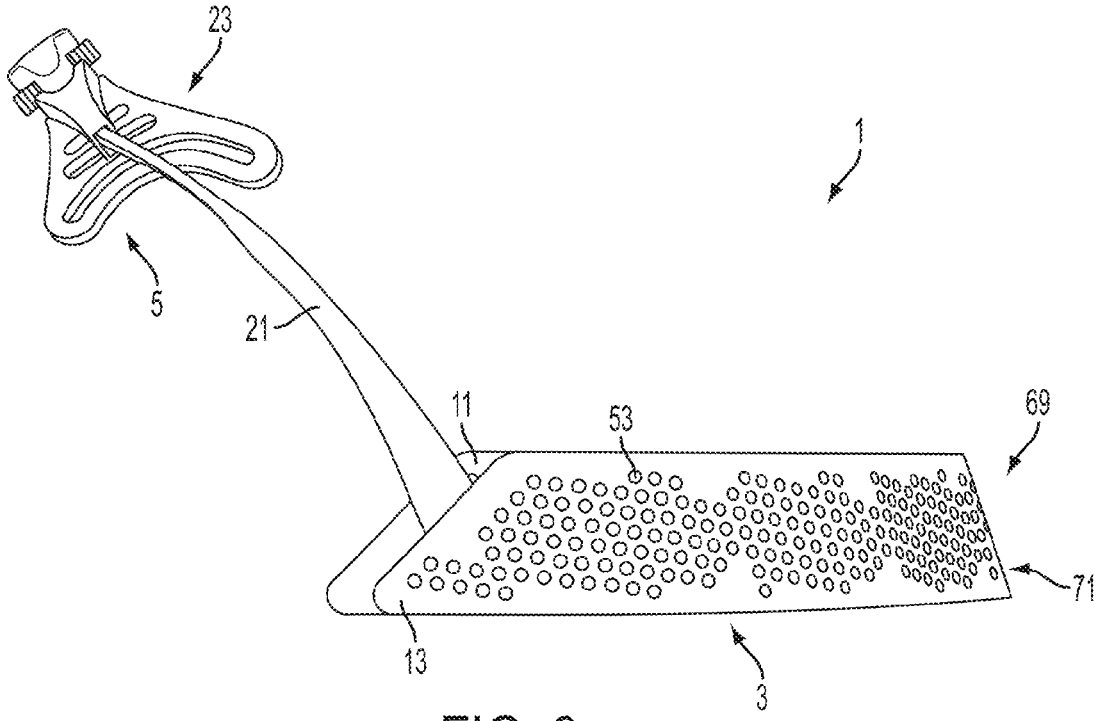
FIG. 3 is a side view of the head band of FIG. 1.

Referring now to FIGS. 2 and 3, according to an embodiment, the tightening portion 5 may be hingedly attached to the band portion 3 of the head band 1. The tightening portion 5 may be selectively hinged upwardly or downwardly to generally accommodate head shapes of different people. According to embodiments, the band portion 3 and/or tightening portion 5, and their various components may be molded from a plastic or resin, or alternatively, may be formed of a composite material, alloy, recycled material, or other materials known in the art.

Figure 6:
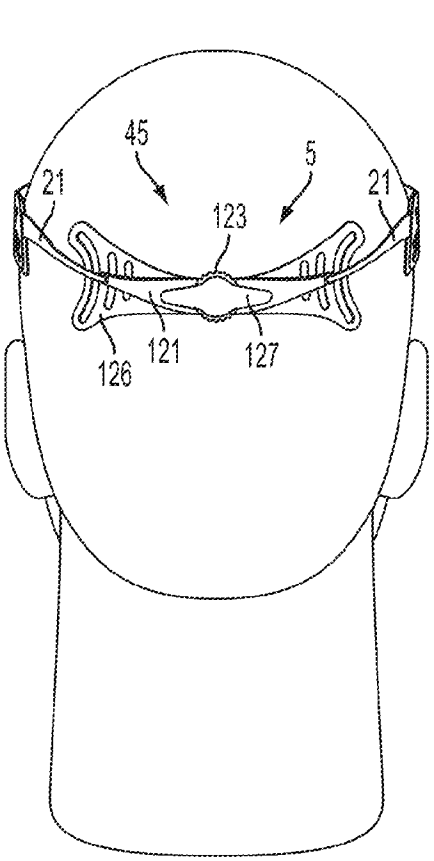
FIG. 6 is a rear view of the head band of FIG. 1, shown for illustrative purposes on a head.

Referring now to FIGS. 4, 5, and 6, the head band 1 is shown as worn on a head. According to an embodiment, the band portion 3 is sized to generally extend around the forehead area 41 of the head and the tightening portion 5 is sized to generally extend around the sides 43 and back of the head 45. However, according to other embodiments, it is foreseen that the band portion 3 may extend further around to the sides of the head 43 or the back of the head 45 or to cover just a portion of the forehead. Further, according to other embodiments, it is foreseen that the band portion 3 may be wider or thinner to provide larger or smaller areas of wicking or air flow to the person's head or forehead 41, 43, 45. Still further, embodiments may exclude the tightening portion 5 and have the band portion 3 extend all the way around the wearer's head 45.

Figure 7:
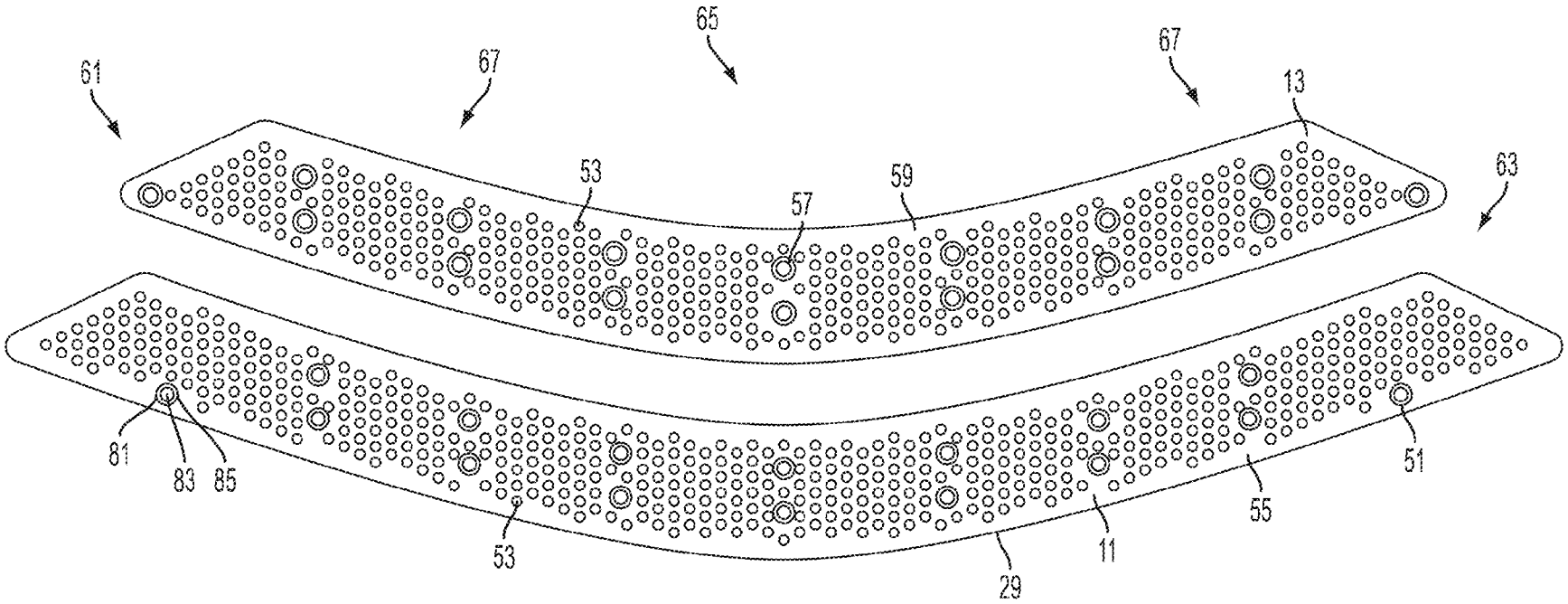
FIG. 7 is a disassembled top view of inner and outer bands of the head band of FIG. 1.
Figure 8:
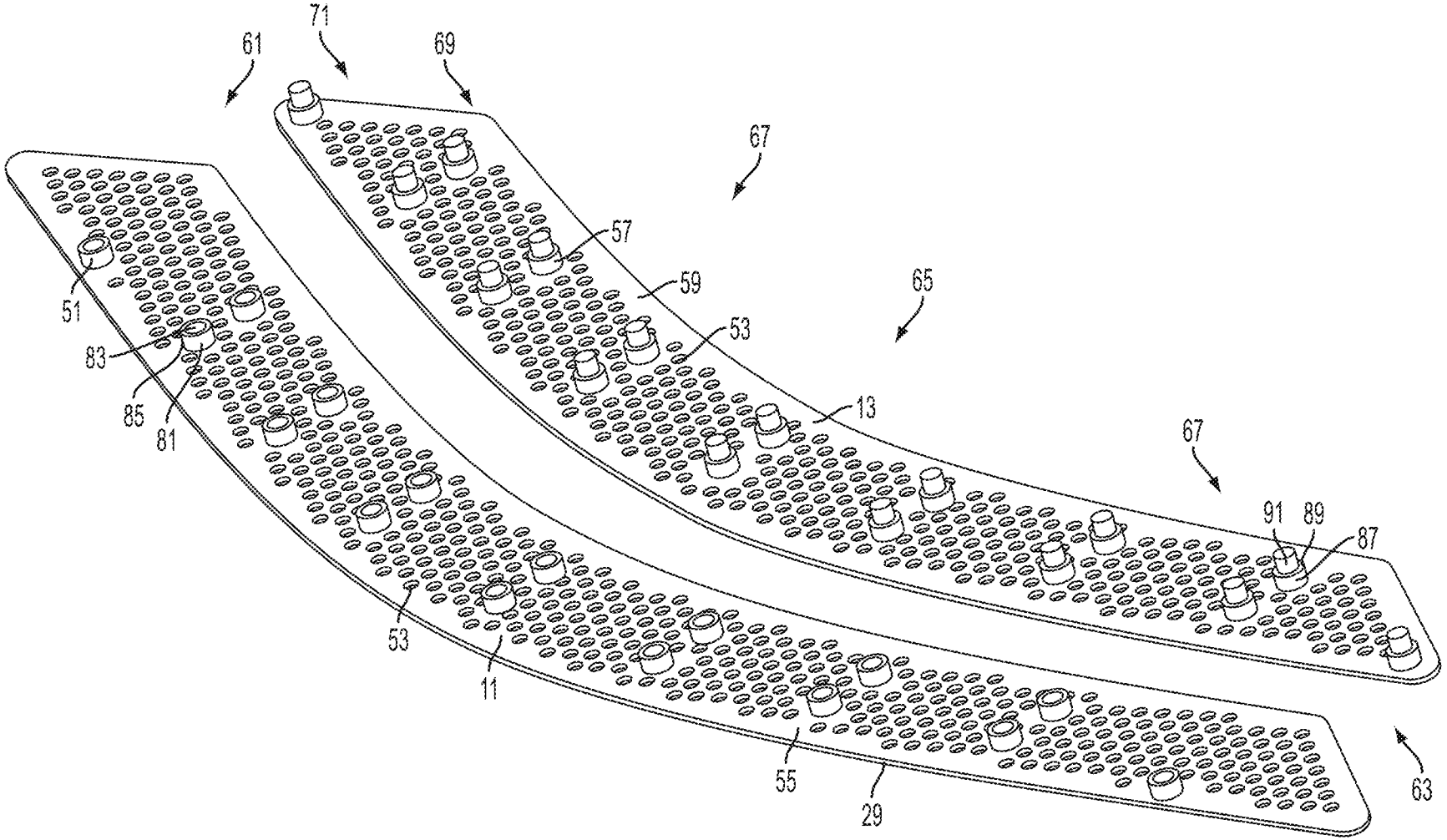
FIG. 8 is a disassembled perspective view of inner and outer bands of the head band of FIG. 1.
Figure 9:
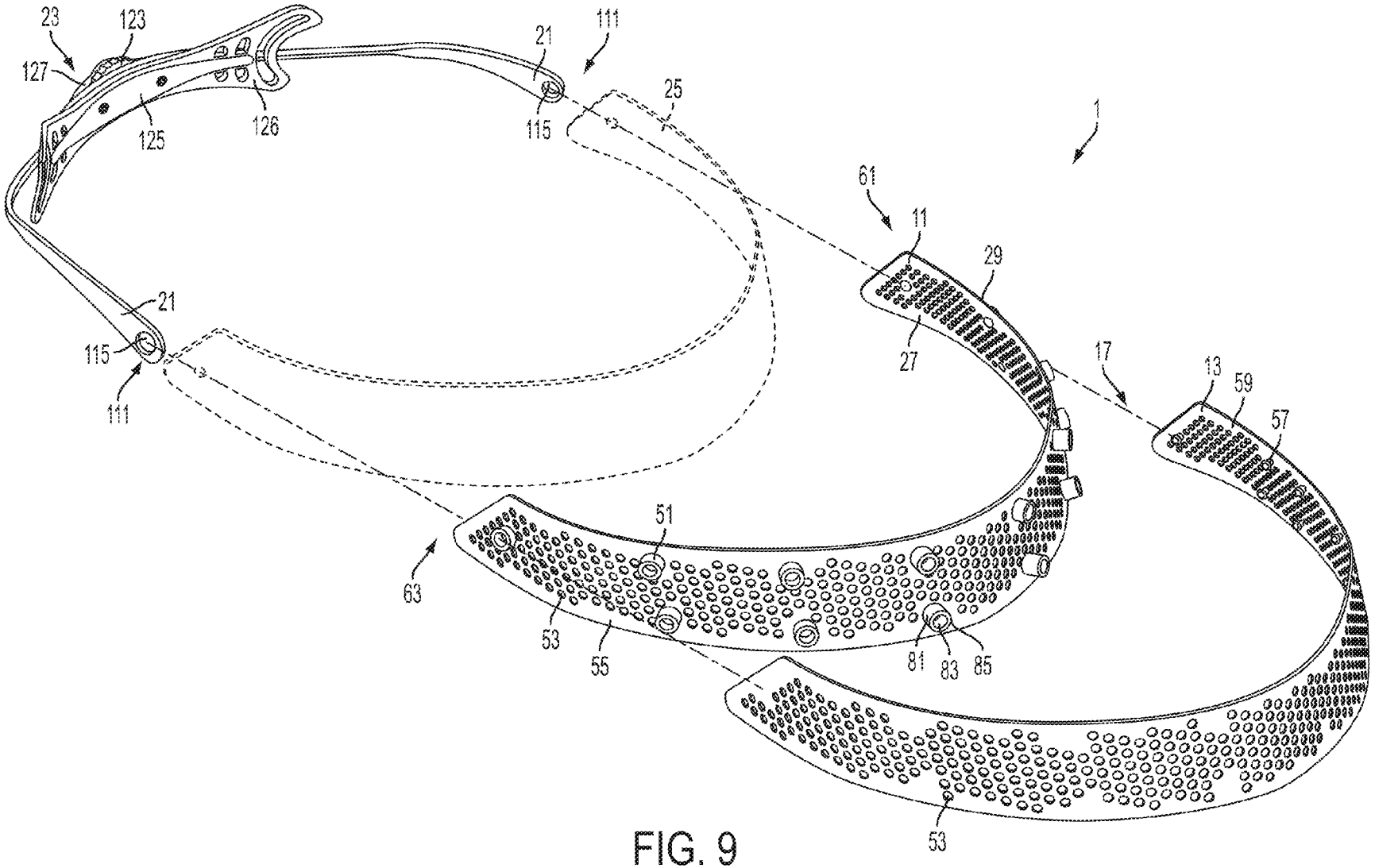
FIG. 9 is an exploded perspective view of the head band of FIG. 1.

Referring now to FIGS. 7, 8, and 9, the first or inner band 11 and the second or outer band 13 are shown. According to an embodiment, the inner and outer bands 11 and 13, respectively, have a curvature in order to generally accommodate head contours when placed on a head. The inner band 11 generally comprises at least one or a plurality of holes 53, such as vent holes, therethrough and female portions 51 of spacer 15 spaced between the holes 53 and extending from an outer surface 55 thereof. The outer band 13 generally comprises at least one or a plurality of holes 53 therethrough and male portions 57 of spacer 15 spaced between the holes 53 extending from an inner surface 59 thereof. According to an embodiment, the inner and outer bands 11, 13 may have holes 53 therein from substantially first to second ends 61, 63. According to other embodiments, the holes 53 may be only in certain portions of the inner and outer bands 11, 13, such as, for example, only in a central portion 65 of the bands 11 and 13 or only in peripheral portions 67 of the bands 11 and 13. According to an embodiment, the holes 53 may be approximately 0.5 mm to 5 mm in diameter. According to another embodiment, the holes 53 may be approximately 0.5 mm to 3 mm. According to yet another embodiment, the holes 53 may be approximately 1 mm to 2 mm. According to other embodiments, the holes 53 may be other shapes such as squares, polygons, ovals, or other geometric or non-geometric shapes.

According to embodiments, the outer surface 55 of the inner band 11 may be provided with only one or a plurality of female portions 51 of spacer 15. The female portions 51 may be provided at upper and lower regions 69 and 71 and evenly spaced at central and peripheral portions of inner band 11. According to embodiments, the female portions 51 may be attached to or integral with the inner band 11. It is foreseen, for example, that the female portions 51 and inner band 11 may be integrally molded from a plastic or resin.

Similarly, the inner surface 59 of outer band 13 may be provided with only one or a plurality of male portions 57 of spacer 15 corresponding to locations of the female portions 51 of inner band 11. According to an embodiment, the same number of female portions 51 and male portions 57 are provided. The male portions 57 may be provided at upper and lower regions 69, 71 and evenly spaced at central and peripheral portions of outer band 13. According to embodiments, the male portions 57 may be attached to or integral with the outer band 13. It is foreseen, for example, that the male portions 57 and outer band 13 may be integrally molded from a plastic or resin. One of ordinary skill will understand that the male portions 57 can alternatively be located on the outer surface 55 of the inner band 11, with the female portions 51 located on the inner surface of the outer band 13. Referring now to FIGS. 8 and 9, as explained above, the spacers 15 may comprise the female portions 51 and male portions 57 extending from the outer surface 55 of inner band 11 and inner surface 59 of outer band 13. The female portions 51 may comprise sidewalls 81 forming a receiver 83 and engagement surface 85. The male portions 57 may comprise a base 87 having an engagement surface 89 and a connector 91 extending therefrom. According to an embodiment, when the inner band 11 and outer band 13 are assembled, the connector 91 of the male portion 57 is received by the receiver 83 of the female portion 51 and the engagement surfaces of the male and female portions 85, 89, respectively, mate with each other. According to an embodiment, the connector 91 of the male portion 57 is sized to have an interference fit with the with receiver 83 of the female portion 51, thereby simultaneously attaching the inner and outer bands 11 and 13 together and spacing the inner and outer bands 11 and 13 apart to form the air space or gap 17. As will be apparent to one of ordinary skill in art using this disclosure, the dimensions of the male and female portions 51, 57 may be adjusted to adjust the air space or gap 17. It is foreseen that fewer or more spacers may be provided with the head band 1 and in any of various configurations. According to an embodiment the air space or gap 17 may be approximately 1 mm to 5 mm. According to another embodiment, the air space or gap 17 may be approximately 1 mm to 3 mm. According to yet another embodiments, the air space or gap 17 may be approximately 2 mm to 3 mm. According to other embodiments, the air space or gap 17 may be substantially uniform across the entire air space or gap 17 between the bands 11 and 13. According to still other embodiments, the air space or gap 17 may vary, such as, for example, 1 mm to 2 mm at the peripheral ends of the air space or gap 17 and 2 mm to 3 mm at a central portion of the air space or gap 17.

Figure 14:
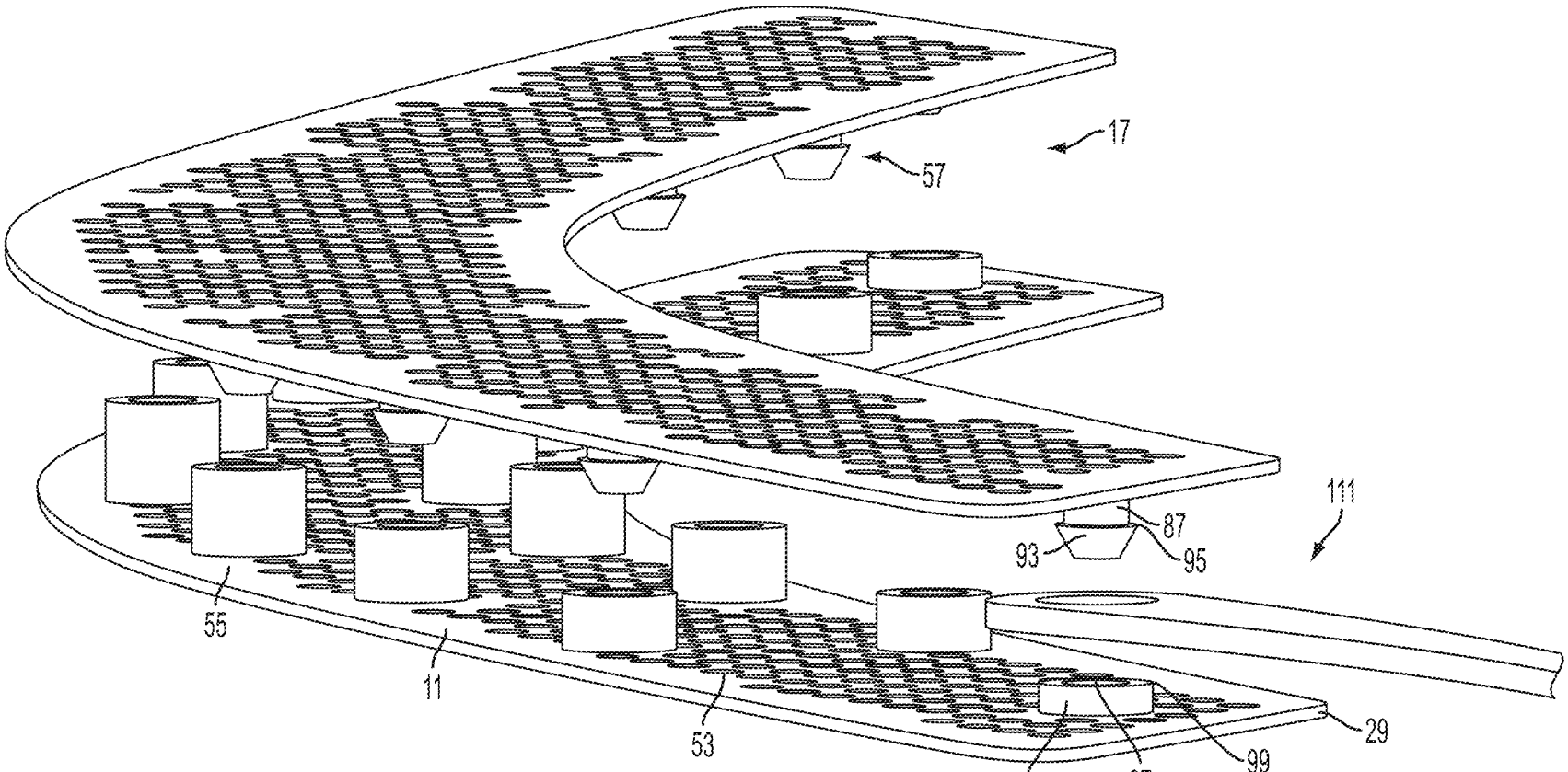
FIG. 14 is a exploded, perspective view of a portion of an embodiment of a head band, showing how portions of the head band attach to one another.

Referring now to FIG. 14, according to an embodiment, the male portion 57 of spacer 15 may comprise the base 87 and a sloped connector 93 having an attachment edge 95. The female portion 51 may comprise a receiver 97 and a lip 99. When the inner band 11 and outer band 13 are assembled, the sloped connector 93 of the male portion 57 may be received by the receiver 97 of the female portion 51 whereby the attachment edge 95 of the male portion 57 may be captured by the bottom surface (not shown) of the lip 99, thereby simultaneously attaching the inner and outer bands 11 and 13 together and spacing the inner and outer bands 11 and 13 apart to form the air space or gap 17. As will be apparent to one of ordinary skill in art using this disclosure, the dimensions of the male and female portions 51 and 57, respectively, may be adjusted to adjust the air space or gap 17. According to an embodiment, the dimensions of the male and female portions 57 and 51, respectively, may be sized such that the upper surface of lip 99 engages the inner surface 59 of outer band 13 in order to prevent relative movement of the inner and outer bands 11 and 13. One of ordinary skill will understand based on this disclosure that the spacer(s) 15 are not limited to the male/female interconnecting configuration shown, and that other embodiments are possible, including those where the inner band 11, outer band 13, and spacer(s) 15 are all or substantially one piece (e.g., monolithic).

Referring again to FIG. 1, the air space or gap 17 may allow, for example, air or fluid flow between the inner and outer bands 11 and 13. For example, cool air may flow from outside the outer band 13 and through the inner band 11 to provide cooling to the head. Similarly, hot air or fluid may flow from inner band 11 and through the outer band 13 to provide heat dissipation from the wearer. Accordingly, according to an embodiment, the air space or gap 17 may provide enhanced heat transfer between a person's head and the ambient environment.

Figure 10:
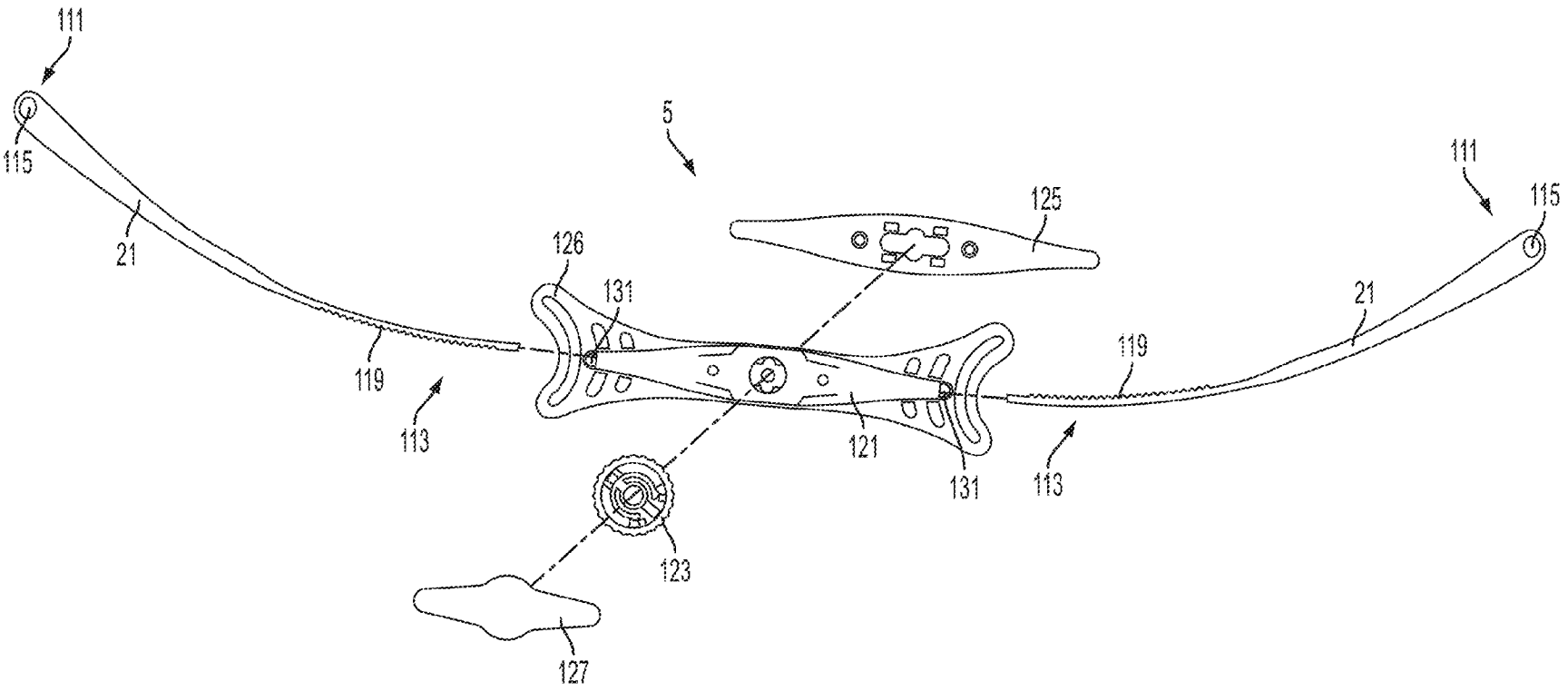
FIG. 10 is an exploded perspective view of a tightening assembly of the head band of FIG. 1.

Referring now to FIGS. 9, 10, and 14, the tightening portion 5 may be hingedly attached to the band portion 3 of the head band 1. As explained above, the tightening portion 5 may generally comprise two straps 21 and a tightening mechanism 23. As can be seen at FIG. 10, the strap 21 may comprise an attachment end 111 and a back end 113 for attaching to the tightening mechanism 23. The attachment ends 111 may form a hole 115 to hingedly attach the strap 21 to the band portion 3. According to an embodiment, the hole 115 is sized to fit around the receiver 83 of the female portion 51 and/or the base 87 of the male portion 57 of spacer 15. In an embodiment such as in FIG. 14, the hole 115 is sized to have an interference fit with the outer diameter of the receiver 83 and/or base 87 in order to selectively pivot the tightening portion 5 relative to the band portion 3, however, alternative arrangements are possible. According to an embodiment, as can be seen at FIG. 14, the receiver 97 has a larger diameter than base 87, so the hole 115 is size to fit around base 87 of the male portion 57. Accordingly, the height of receiver 83 may be adjusted to accommodate the thickness of attachment end 111 and maintain a preselected size of air gap or space 17. One of ordinary skill in the art will appreciate from this disclosure that the tightening portion 5 is not limited to attachment to the band portion 3 via the spacers 15. Rather, separate structures, such as any of the hinge-type structures known in the art, including living hinges, can be used to provide a connection between the band portion 3 and the tightening portion 5. Moreover, alternative embodiments are envisioned where the band portion 3 and tightening portion 5 attach, or are one piece, without any type of intervening hinge.

Referring now to FIG. 10, according to an embodiment, the tightening mechanism 23 may comprise a rack-and-pinion-type tightening mechanism 23. Accordingly, the back ends 113 of strap 21 may have rack teeth 119. The rack-and-pinion-type tightening mechanism 23 may generally comprise housing 121, a pinion wheel 123, cover member 125, and knob 127. The pinion wheel 123 is rotatably mounted within housing 121. According to an embodiment, in order to facilitate assembly, the housing 121 may have an open cavity (not shown) on the rear of the housing 121 for mounting the pinion wheel 123. Cover member 125 may be mounted on the rear of the housing 121 with, for example, a rivet, glue, or any other type of suitable fastener as known to one of ordinary skill in the art. According to an embodiment, the cover member 125 may provide additional rigidity to the tightening mechanism 23 and protect the wearer from the rotation of the pinion wheel 123. According to an embodiment, the housing 121 may further comprise a web 126 to fit to a person's head thereby enhancing stability and comfort on the head. On the side opposite the support member, the knob 127 may be provided to conceal and/or rotate the pinion wheel 123. As such, all or a portion of the knob 127 may be fixedly mounted with pinion wheel 123 to rotate with the pinion wheel 123. The housing 121 may further comprise strap receivers 131 at each end thereof. The strap receivers may receive the back ends 113 of strap 21 having the rack teeth 119.

Referring now to FIG. 6, when the head band 1 is worn, the tightening portion 5 may be pivoted to adjust to the head shape. According to an embodiment, the knob 127 may be rotated to engage the pinion wheel 123 with the rack teeth 119 of straps 21. Thus, the head band 1 size may be adjusted according to a person's head size or desired tightness. Upon tightening the head band 1, the air space or gap 17 may be maintained between the inner and outer bands 11 and 13 with spacers 15.

According to other embodiments, other tightening mechanisms may be used. For example, a ratcheting assembly, hook-and-loop fastener, buckle, clasp, or other tightening mechanism may be used to tighten the head band 1.

Figure 11:
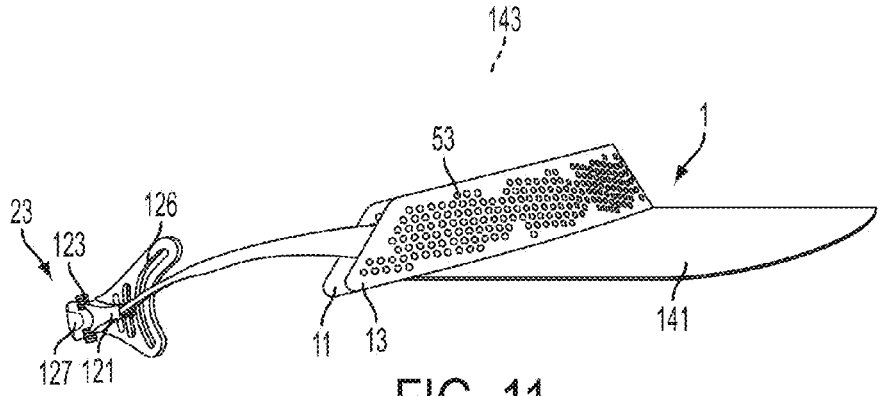
FIG. 11 is side view of an embodiment of a head band visor.
Figure 12:
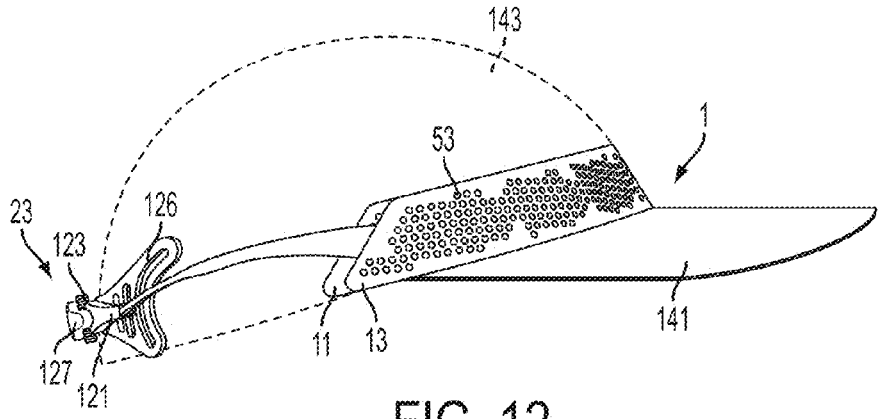
FIG. 12 is a side view of an embodiment of a head band cap.
Figure 13:
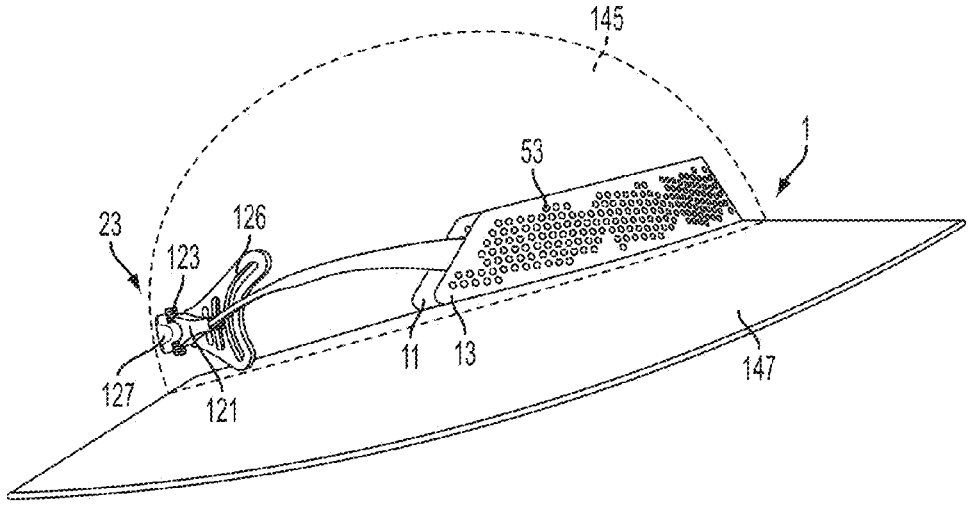
FIG. 13 is side view of an embodiment of a head band bush hat.

Referring to FIGS. 11, 12, and 13, the head band 1 may be used with a variety of styles of hats and in various manners. For example, referring now to FIG. 11, the head band 1 may be used in combination with a visor 141. The visor 141 may be affixed directly to a bottom edge of the head band 1. In particular, the visor 141 may be affixed directly to the bottom edge of the outer band 13. According to an embodiment, the visor may be formed integrally with the outer band 13. All or a portion of the visor 141 and head band 1 may be covered in a decorative fabric, or alternatively, the parts can be exposed.

Referring now to FIG. 12, the head band 1 may be used in combination with a cap 143, such as a fabric hat worn, for example, during athletic activities. According to an embodiment, the visor 141 may be affixed or formed integrally with the outer band 13. According to an embodiment, the cap portion 143 may be affixed to the either the top edge of the outer band, as shown at FIG. 12, such that the outer band 13 and holes 53 are exposed. According to another embodiment, the cap portion 143 may be affixed to the visor 141 such that the outer band 13 and holes 53 are covered by the cap portion 143. The cap portion 143 may be affixed by, for example, stitching, glue, rivets, or other suitable fasteners as known to one of ordinary skill in the art. According to an embodiment, the cap portion 143 may be a fabric, such as, for example, cotton, polyester, wool, gore-tex, polyester, synthetic fabric, or other types of fabrics as known to one of ordinary skill in the art. According to other embodiments, the cap portion 143 may be a rigid material such as molded plastic, metal, or other rigid materials as known to one of ordinary skill in the art.

According to an embodiment, the tightening mechanism 23 may extend outside the cap 143 such as, for example, through an opening in the cap 143. According to an embodiment, only the knob 127, pinion wheel 123, and a portion of the housing 121 extend outside the cap 143.

Referring now to FIG. 13, the head band 1 may be used in combination with a bush hat 145 having a full brim 147. The bush hat 145 may extend over the head band 1 and affix directly to the full brim 147. The head band 1 may be affixed to the inside of the bush cap 145 by affixing the outer band 13 onto the inside of the bush cap 145 such as by, for example, stitching, glue, rivets, or other suitable fastener as known to one of ordinary skill in the art. According to an embodiment, the bush hat 145 and brim 147 may be a fabric, such as, for example, cotton, polyester, wool, gore-tex, polyester, synthetic fabric, or other types of fabrics as known to one of ordinary skill in the art. According to other embodiments, the bush hat 145 and brim 147 may be a rigid material such as molded plastic, metal, or other rigid materials as known to one of ordinary skill in the art. According to other embodiments, the bush hat 145 and brim 147 may be of any combination of fabrics or materials as known to one of ordinary skill in the art.

As illustrated by the various embodiments, the head band 1 may be used, for example, as a stand-alone band or in combination with visors, caps, bush hats, or other articles of clothing. According to some embodiments, and as illustrated above, the outer band 13 may be affixed to or into a cap, visor, or bush hat, for example. Thus, the inner band 11 and tightening portion 4 may be affixed to the outer band 13 with the spacers 15, as described above, after the outer band 13 is affixed to the cap or other article. According to an embodiment, the inner band 11 and tightening portion 5 are removable by detaching the inner band 11 from the outer band 13. According to another embodiment, the head band 1 can be removed from the visor, cap, or bush hat for cleaning, or for use as a stand alone head band.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

I claim:

1. A head band comprising:

a band portion and a tightening portion;

the band portion having a first band and a second band, wherein an outer surface of the first band opposes an inner surface of the second band; and at least one spacer between the first and the second band forming a gap between the first band and the second band;

the tightening portion having a strap and a tightener configured to tighten the strap, wherein the strap is hingedly connected at approximately each end of the band portion, wherein the strap of the tightening portion is hingedly attached to the band portion by the at least one spacer.

2. The head band of claim 1, wherein the at least one spacer further comprises a female portion extending from the outer surface of the first band, and a male portion extending from the inner surface of the second band, wherein the female portion receives the male portion to removably attach the first band and the second band.

3. The head band of claim 2, further comprising the male portion extending from the inner surface of the second band having a sloped surface, the female portion having a receiver, wherein a dimension of the sloped surface is smaller than a dimension of the receiver, and another dimension of the sloped surface is larger than another dimension of the receiver.

4. The head band of claim 1, wherein the first band portion and the second band portion each have an array of vent holes therethrough.

5. The head band of claim 1, wherein the strap further comprises a first strap and a second strap, the first and second straps each hingedly connected at one end on the spacer arranged at approximately each end of the band portion, the first and second straps connected at a second end by the tightener.

6. The head band of claim 5, wherein the tightener receives the second ends of the first and second straps, and wherein the tightener is configured to selectively tighten or loosen the first and second straps.

7. The head band of claim 6, wherein the tightener is a rack-and-pinion mechanism and the first and second straps each have rack teeth, the rack-and-pinion mechanism having a rotatable pinion wheel having pinion teeth, wherein the pinion teeth engage the rack teeth, wherein the pinion wheel is rotatable to selectively tighten or loosen the first and second straps.

8. The head band of claim 1, further comprising the second band having a visor extending from an outer surface thereof.

9. The head band of claim 8, further comprising a cap attached to an upper end of the second band.

10. The head band of claim 1, further comprising attaching the second band to an inner surface of a cap.

11. The head band of claim 9, wherein the first band is removable from the second band.

12. The head band of claim 1, further comprising a fabric covering an inner surface of the first band.

13. The head band of claim 1, wherein the first band and the second band are attached to each other with only the at least one spacer.

14. An apparatus for wearing on a head comprising:

a band portion and a tightening portion;

the band portion having a first band and a second band, wherein an outer surface of the first band opposes an inner surface of the second band;

at least one spacer between the first band and the second band forming a gap between the first band and the second band;

a visor extending from a bottom edge of an outer surface of the second band;

the tightening portion having a strap and a tightener configured to tighten the strap, wherein the strap is hingedly connected at approximately each end of the band portion, wherein the strap of the tightening portion is hingedly attached to the band portion by the at least one spacer.

15. The cap of claim 14, wherein the visor is formed integrally with at least one of the first band or the second band.

16. An apparatus for wearing on a head comprising:

a band portion and a tightening portion;

the band portion having a first band and a second band, wherein an outer surface of the first band opposes an inner surface of the second band;

at least one spacer between the first band and the second band forming a gap between the first band and the second band;

a visor extending from a bottom edge of an outer surface of the second band;

the tightening portion having a strap and a tightener configured to tighten the strap, wherein the strap is hingedly connected to the at least one spacer at approximately each end of the band portion; and a cap portion, wherein the cap portion is attached to the band portion; wherein the tightener protrudes from an opening in the cap portion.

17. The cap of claim 16, wherein the visor is formed integrally with the second band.

18. An apparatus for wearing on a head comprising:

a band portion and a tightening portion;

the band portion having a first band and a second band, wherein an outer surface of the first band opposes an inner surface of the second band;

at least one spacer between the first band and the second band forming a gap between the first band and the second band;

the tightening portion having a strap and a tightener configured to tighten the strap, wherein the strap is hingedly connected at approximately each end of the band portion; and a hat portion, wherein the hat portion extends over an outer surface of the second band, wherein the strap of the tightening portion is hingedly attached to the band portion by the at least one spacer.

19. The cap of claim 18, further comprising a visor extending from a bottom edge of an outer surface of the second band.

20. The cap of claim 19, wherein the visor is formed integrally with at least one of the first band or the second band.

21. The cap of claim 19, wherein the hat portion is attached directly to the visor.

22. The cap of claim 21, wherein the hat portion is attached directly to the second band.

* * * * *